US006748185B2

(12) United States Patent
Song

(10) Patent No.: US 6,748,185 B2
(45) Date of Patent: Jun. 8, 2004

(54) COPIER PRE-DISPLAYING SCANNED IMAGE AND CONTROL METHOD THEREOF

(75) Inventor: Gwan-seob Song, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/153,915

(22) Filed: May 24, 2002

(65) Prior Publication Data

US 2003/0086720 A1 May 8, 2003

(30) Foreign Application Priority Data

Nov. 5, 2001 (KR) ..... 2001-68597

(51) Int. Cl.[7] ..... G03G 15/00; G03G 21/00
(52) U.S. Cl. ..... 399/81; 399/38; 399/194
(58) Field of Search ..... 399/81, 86, 194, 399/196, 200, 38; 358/1.2, 474; 361/681

(56) References Cited

U.S. PATENT DOCUMENTS 5,794,104 A * 8/1998 Maruyama ..... 399/194 X
5,819,143 A * 10/1998 Sakai et al. ..... 399/194
6,157,439 A * 12/2000 Rousseau et al. ..... 355/61
6,285,842 B1 * 9/2001 Katamoto et al. ..... 399/81
6,308,023 B1 * 10/2001 Nomura et al. ..... 399/81
6,415,110 B1 * 7/2002 Kimura ..... 399/81 X
6,516,178 B2 * 2/2003 Fukushima ..... 399/81 X
6,643,492 B1 * 11/2003 Kuga ..... 399/38 X
2002/0136560 A1 * 9/2002 Sadowara et al. ..... 399/81 X

* cited by examiner

*Primary Examiner*—Sophia S. Chen
(74) *Attorney, Agent, or Firm*—Staas & Halsey LLP

(57) ABSTRACT

A copier scans an original document and displays the scanned image together with a printing image of the printing paper corresponding to the scanned image. Prior to a copy operation, a printing status of the scanned image to be printed on the printing paper is checked. The user sets a position, a size and an angle of the scanned image on the printing paper. The printing paper is selected by a selecting command input from a user, or the printing paper that is closest to the scanned image in size and position can be automatically selected. The user obtains a correct copy as intended easily even when the size of the original document and the printing paper are different from each other, or when the user only wants to copy a partial image of the scanned image.

41 Claims, 8 Drawing Sheets

COPIER PRE-DISPLAYING SCANNED IMAGE AND CONTROL METHOD THEREOF

CROSS-REFERENCE TO RELATED APPLICATIONS

This application claims the benefit of Korean Patent Application No. 2001-68597 filed on Nov. 5, 2001, in the Korean Industrial Property Office, the disclosure of which is incorporated herein by reference.

BACKGROUND OF THE INVENTION

1. Field of the Invention

The present invention relates to a photocopying apparatus, and more particularly, to a copier having a liquid crystal display displaying a scanned image of a document and a printing image of printing paper and a touch panel adjusting the scanned image and the printing image, and method thereof.

2. Description of the Related Art

Generally, in order to copy a document having a certain size onto a different sized sheet of paper, a user of a copier usually makes several errors until a correct copy is obtained as the user intends.

For example, in order to copy two pages of a book onto one sheet of printing paper, which is different from the pages of the book in size, the user needs to adjust the size and position of a scanned image of the the two pages to the size and position of the printing paper. Conventionally, the user adjusts the size using a series of predetermined manual adjustments in the copier. As to the position of the scanned image, the user has to guess a position of the two pages of the book depending on the experience in the past when the book is placed on a platen glass of the copier. Accordingly, the user has no choice but to repeat until the correct copy is obtained as the user intended.

When the document is scanned prior to a copy operation, and thus the differences between the images of the document and the printing paper can be adjusted by the user, the user might obtain the correct copy through the precise adjustments in the size and position without the waste of paper and time for the copy operation.

SUMMARY OF THE INVENTION

The present invention has been made to overcome the problems of the related art, and accordingly, it is an object of the present invention to provide a copier informing a user of a printing state of a scanned image of an original document on printing paper, and avoiding an error in a copy operation.

It is another object of the present invention to provide a copier providing a user of the copier with the convenience of dealing with the copier by allowing the user to set the printing state of the scanned image of the original document on the printing paper and to select a type of the printing paper.

Additional objects and advantages of the invention will be set forth in part in the description which follows and, in part, will be obvious from the description, or may be learned by practice of the invention.

These and other objects are achieved by providing a copier including a scanning portion scanning a document, a cartridge containing at least one type of printing paper, an output portion printing a scanned image of the document onto the printing paper, and a display portion displaying the scanned image and a printing image representing a state that the scanned image of the document is printed on the printing paper.

Also provided is an input portion enabling a user to input a setting command setting at least one of a position, a size and an angle of the scanned image of the document to be printed on the printing paper. The display portion displays the scanned image of the document in response to the setting command. Through the input portion, the user can set a printing state of the scanned image of the document on the printing paper as the user intends and also selects correct printing paper for printing the set scanned image of the document. Also, the usual problems occurring with the conventional copier, i.e., the waste of time and paper can be avoided.

Among various types of printing paper contained in the cartridge, the printing paper having the most similar size as the scanned image of the document is selected, and the printing image corresponding to the printing paper is displayed in the display portion automatically.

A sensor is disposed in the scan portion to sense an opening and closing of a cover that covers the document placed on the scanning portion. The display portion displays the scanned image when the sensor detects the closing of the cover.

Meanwhile, a method of controlling a copying operation of the copier includes scanning an image of a document, displaying the scanned image of the document and a printing image representing a state that the scanned image of the document is printed on printing paper, inputting a setting command set by a user setting at least one of a position, a size and angle of the scanned image of the document to be printed on the printing paper, re-displaying the scanned image and the printing image in response to the setting command, and outputting the re-displayed scanned image onto the printing paper according to an input of an output start command. In the inputting operation, the setting command is inputted through a touch panel.

A partial output command can be inputted to print a partial image of the scanned image of the document, and in the re-displaying operation, the partial image of the scanned image is displayed as a second scanned image in response to the partial output command.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
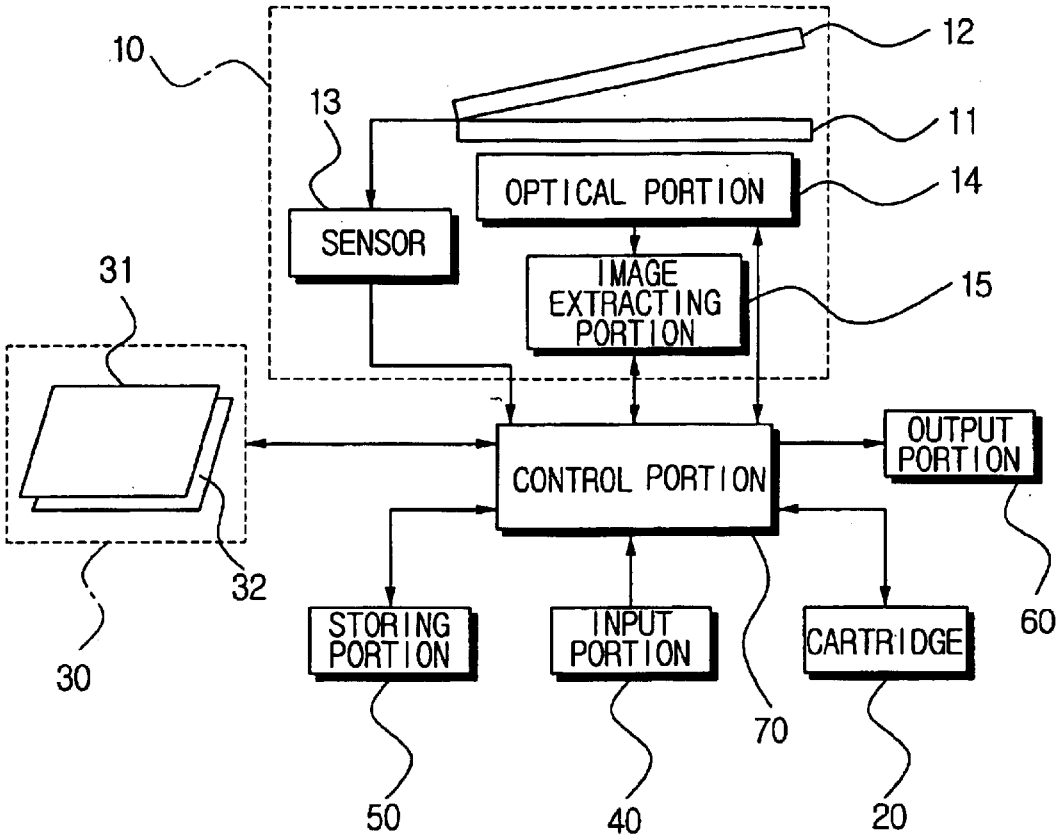
FIG. 1 is a block diagram of a copier according to an embodiment of the present invention.

Reference will now be made in detail to the embodiments of the present invention, examples of which are illustrated in the accompanying drawings, wherein like reference numerals refer to the like elements throughout. The embodiments are described below in order to explain the present invention by referring to the figures.

FIG. 1 is a block diagram showing a digital copier according to an embodiment of the present invention.

The digital copier includes a scan portion 10 scanning an image of an original document, a cartridge 20 holding a stack of printing paper, a display portion 30 displaying a scanned image of the original document and a printing image representing a state that the scanned image of the original document is printed on the printing paper, an input portion 40 inputting a user command, an output portion 60 outputting the scanned image of the original document onto the printing paper, and a control portion 70 controlling the scan portion 10, the cartridge 20, the display portion 30, the storing portion, and the output portion 60 according to the user command inputted through the input portion 40.

The scan portion 10 includes a platen glass 11 on which the original document is placed, a cover plate 12 covering the original document placed on the platen glass 11, a sensor 13 sensing opening/closing of the cover plate 12, an optical portion 14 and an image extracting portion 15. When a user places the original document on the platen glass 11 and covers the document with the cover plate 12, the sensor 13 outputs to the control portion 70 a sensing signal indicating that the cover plate 12 is closed.

Then the control portion 70 drives the optical portion 14 to scan the original document. The optical portion 14 emits an optical signal toward the original document placed on the platen glass 11 and receives a scanned signal reflected from the original document. The image extracting portion 15 extracts a scanned image of the original document based on the scanned signal received from the optical portion 14.

The cartridge 20 holds the printing paper on which the printing image corresponding to the scanned image scanned by the scan portion 10 is printed. The cartridge 20 may either contain one type of the printing paper or various types of the printing paper. For example, the cartridge 20 may contain A4, A3, B5 and B3 sized printing paper therein. The cartridge 20 generates paper type signals, and the control portion 70 receives the paper type signals and selects one of the various types of the printing paper on which the scanned image is printed.

The display portion 30 includes a liquid crystal display (LCD) 32 displaying the printing image of the printing paper and the scanned image of the original document, and a touch panel 31 enabling the user to input the user command by touching a portion of the touch panel 31 corresponding to the user command.

The input portion 40 includes a plurality of input buttons enabling the user to input the user command, such as a setting command, a selecting command and a copy-start command, or the like. The setting command is to set a position, a size and a rotational angle of the scanned image of the original document. The selecting command is to select a desired type or size of the printing paper. When the setting command is inputted, the control portion 70 displays the scanned image of the original document, which is set according to the setting command. When the selecting command is inputted, according to the selecting command, the control portion 70 selects the printing paper, which is closest to the size set by the selecting command, from the cartridge 20 and displays the printing image of the selected printing paper on the LCD device 32. A process of inputting the setting command and the selecting command will be described in greater detail hereinafter.

The user also can input a partial output command through the input portion 40 to print a partial image of the scanned image of the original document on the printing paper. The user can set the partial image from the scanned image as another scanned image by using the same method that is used to set the setting command.

Since the display portion 30 includes the touch panel 31, the user inputs the setting command, the selecting command, and the partial output command through the touch panel by using a touching and dragging method of touching or dragging an appropriate area of the touch panel 31 corresponding to the setting command, the selecting command, and the partial output command. Through the touch panel 31, the position, the size, and the rotation angle of the scanned image with respect to the printing paper are set and adjusted. Also, the desired size of the printing paper and the partial image of the scanned image are selected or adjusted through the touch panel 31. The user also may input the user command by the manipulation of the input buttons provided in the input portion 40. Here, the input buttons may be omitted if only the touch panel is used. Alternatively, the touch panel may be omitted if only the input buttons are used.

The memory portion 50 stores first information about the scanned image of the original document and the printing image of the selected printing paper. The memory portion 50 also stores second information about the set scanned images of the original document and the set printing image of the selected printing paper, which are newly set by the user through the touch panel 31 or the input portion 40.

Figure 2:
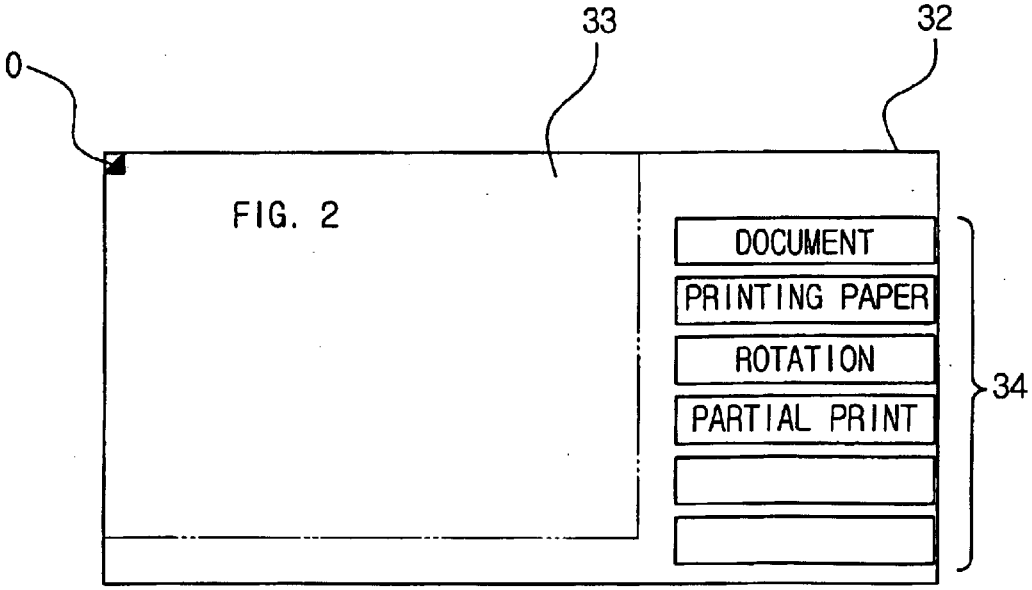
FIG. 2 is a view showing a screen displayed in a liquid crystal display LCD of the copier of FIG. 1.

When the user inputs the copy-start command through the input portion 40, the control portion 70 drives the output portion 60 and thus prints the scanned image of the original document on the printing paper in accordance with the printing image displayed on the LCD 32. In FIG. 2, the LCD 32 includes a pointer "0", a display area 33, and icons 34.

A method of controlling a copy operation of the digital copier according to the embodiment of the present invention will be described hereinafter in greater detail with reference to FIGS. 2 and 3.

First, the user places the original document on the platen glass 11 and covers the original document with the cover plate 12. When the cover plate 12 closes, the sensor 13 generates the sensing signal to the control portion 70, indicating the closing of the cover plate 12. After the cover plate 12 is determined to be closed in operation S1, the control portion 70 drives the optical portion 14. The optical portion 14 emits optical signals onto the original document placed on the platen glass 11 and receives reflected optical signals reflected from the original document. The image extracting portion 15 extracts the scanned image of the original document based on the received optical signals in operation S2.

Figure 8A:
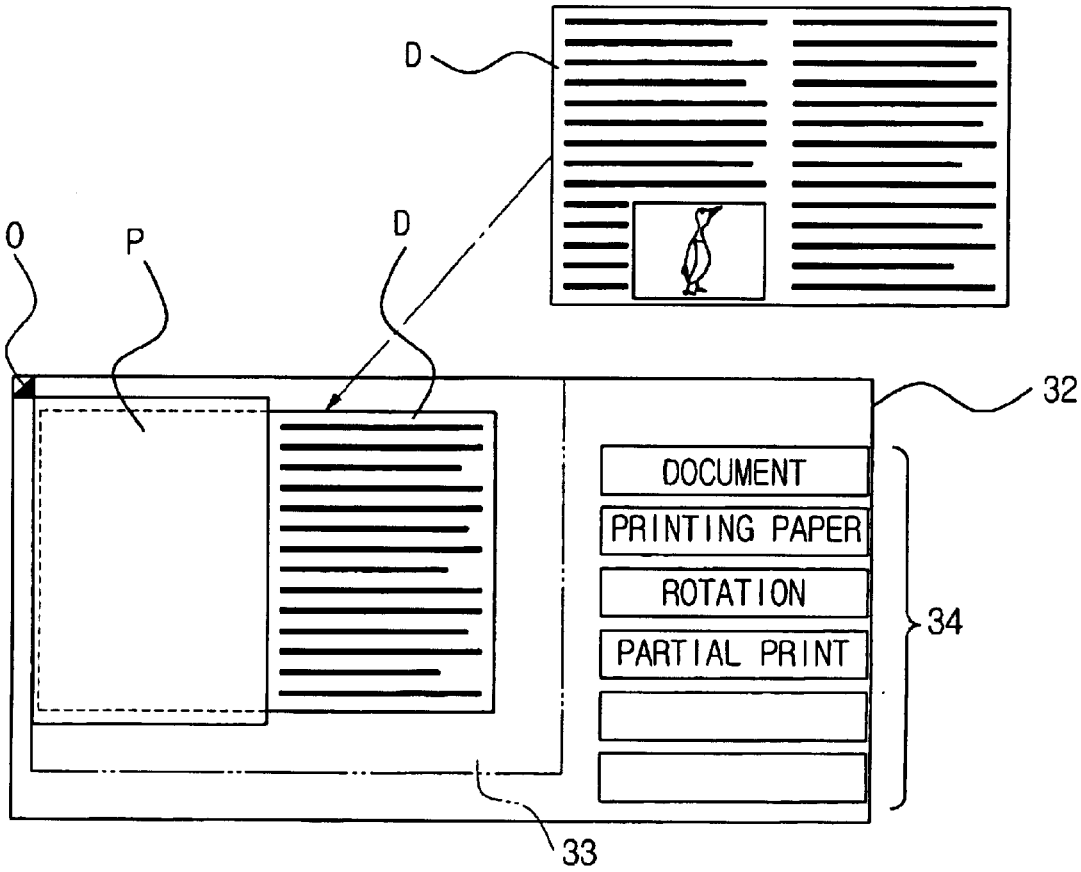
FIGS. 8A through 8E are views explaining the process of setting the images showing the scanned image and the printing image displayed in the LCD of FIG. 1.

The control portion 70 displays the scanned image D of the original document in the display area 33 of the LCD 32 as shown in FIG. 8A in operation S3, checks the type or size of the currently selected printing paper contained in the cartridge 20, and displays the printing image P of the selected printing paper in the LCD 32 as shown in FIG. 8A in operation S3. The scanned image D of the original document in the LCD 32 and the image P of the selected printing paper are stored in the memory portion 50. Once stored in the memory portion 50, the the stored scanned and printing images serve as reference data to a newly set scanned image of the original document that varies according to the setting command and a newly set printing image of the printing paper that is selected by the selecting command. The newly set scanned and printing images are also stored in the memory portion 50. Icons 34 are displayed in the LCD 32 to enable the user to select or input functions like a document mode key setting the scanned image of the original document, a printing paper mode key selecting the printing paper, and a partial output mode key printing the partial image of the document.

With respect to the scanned image D of the original document and the printing image P of the printing paper displayed in the LCD 32, the user inputs the setting command and the selecting command by dragging and touching the appropriate area of the touch panel 31 in operations S4 and S5. The control portion 70 displays the scanned image D of the original document and the printing image P of the printing paper in the display area 33 of the LCD 32. Next, as the user inputs the copy-start command in operation S7, the output portion 60 prints the printing image P on the selected printing paper as displayed in the LCD 32 in operation S8, that is, the output portion 60 prints the newly set printing image corresponding to the newly set scanned image D of the original document on the selected printing paper in operation S6. If the user inputs the copy-start command in operation S7, the scanned image D is printed on the printing paper in operation S8.

The method of setting the scanned and printing images D, P of original document and the printing paper, respectively, in an original document image setting mode and a printing paper selecting mode will be described hereinafter in greater detail with reference to FIGS. 3 through 7 and FIGS. 8A through 8E.

Figure 3:
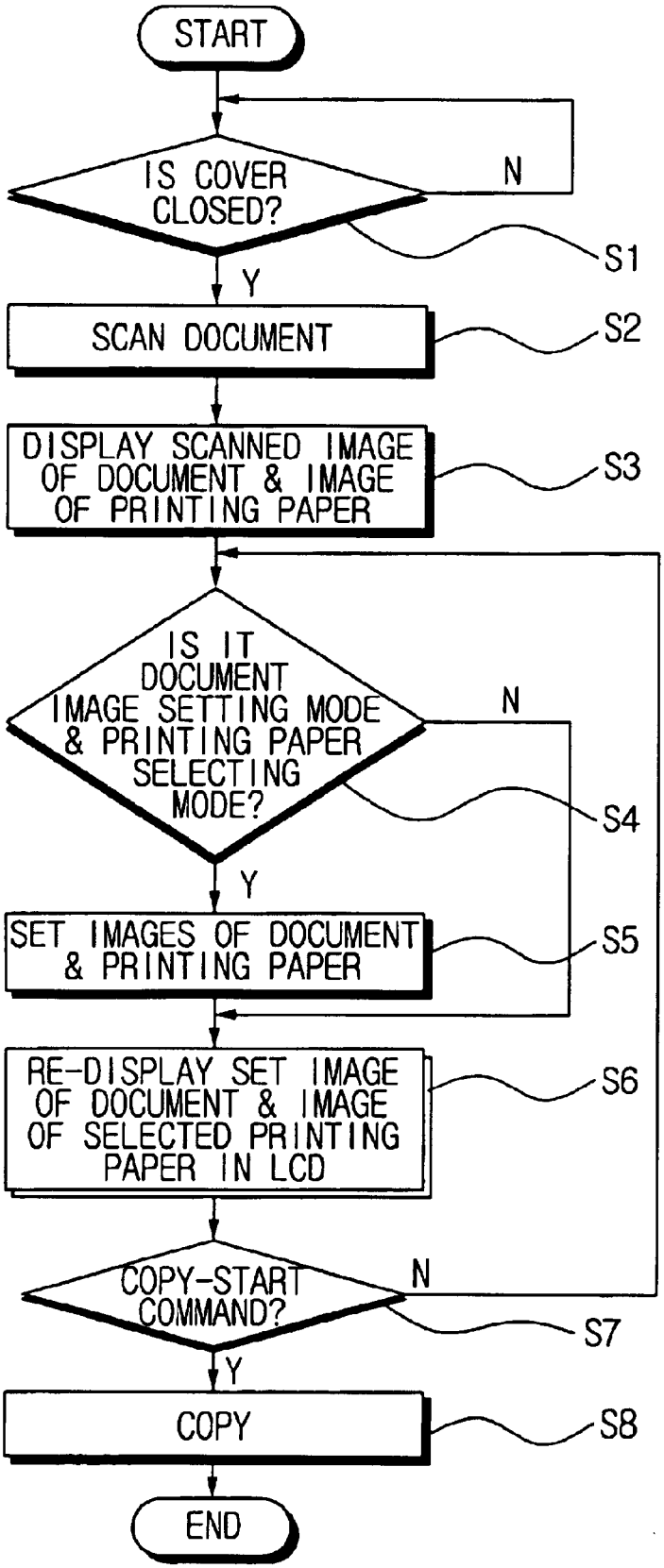
FIG. 3 is a flowchart explaining a copying operation control method of the copier of FIG. 1.
Figure 4:
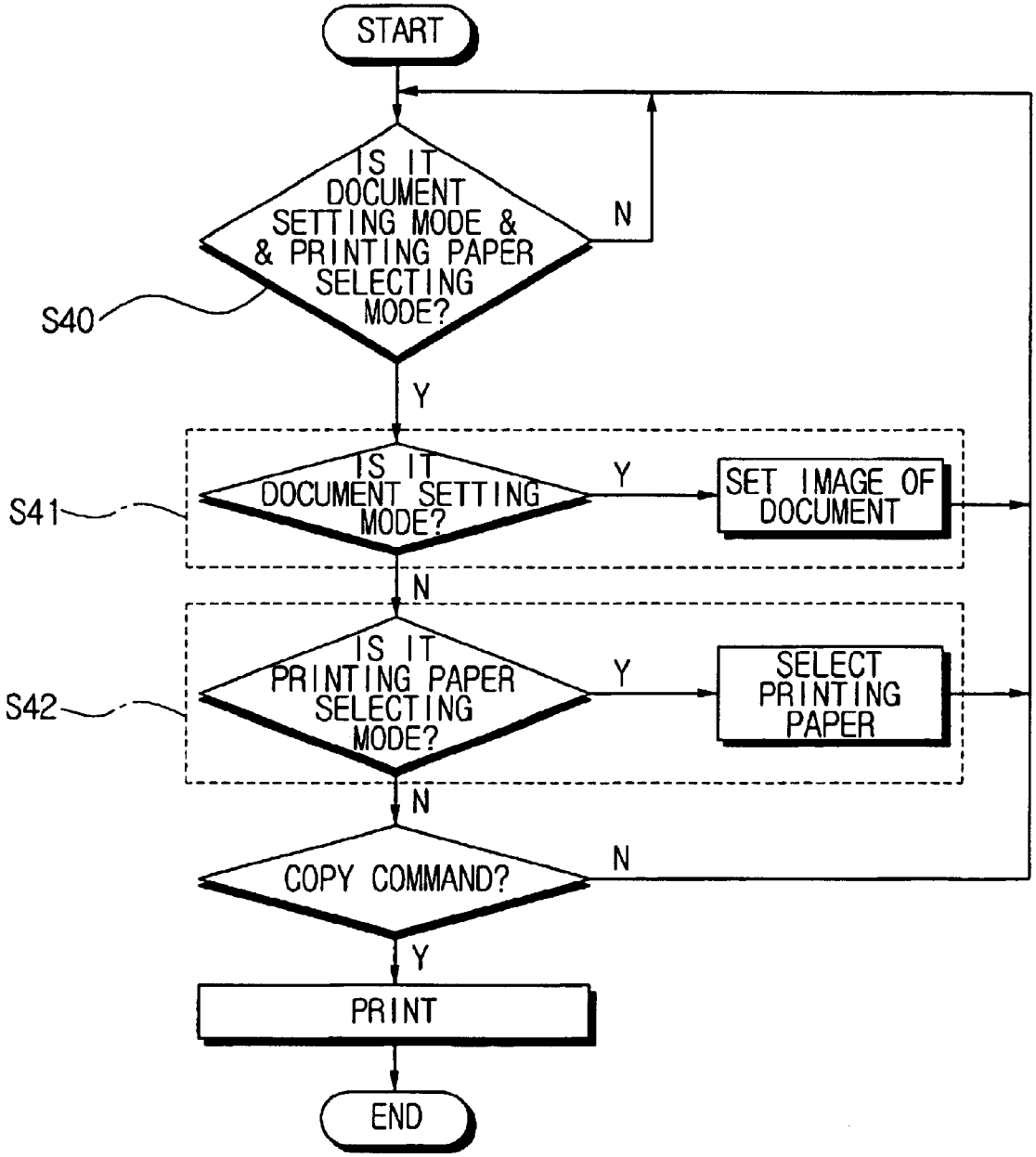
FIGS. 4 through 6 are flowcharts explaining methods of setting a scanned image of an original document and a printing image of printing paper of the copier of FIG. 1.
Figure 7:
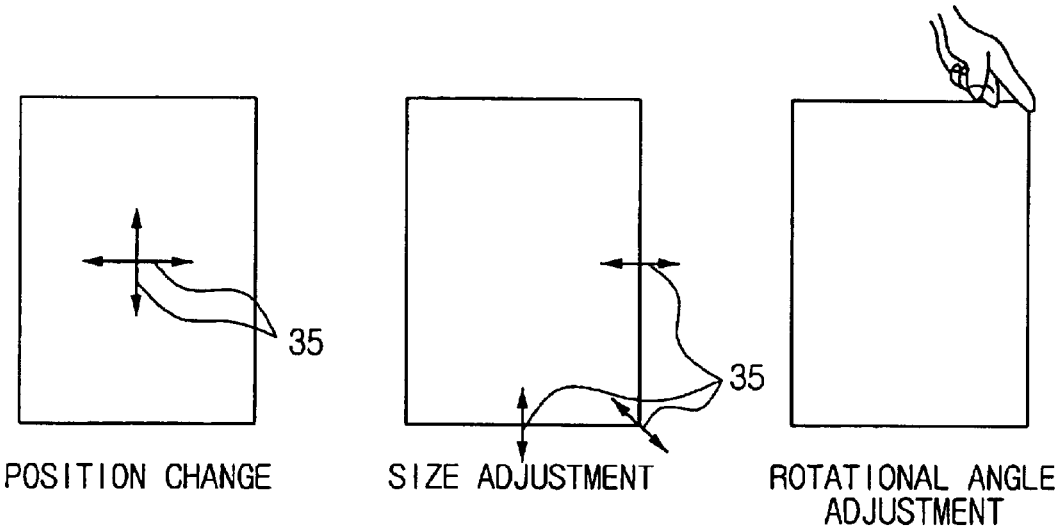
FIG. 7 is a view showing direction keys displayed in the LCD for setting the scanned image of the original document and the printing image of the printing paper of the copier of FIG. 1.

FIG. 4 shows a detailed flow chart of document image setting and printing paper selecting operations S4 and S5 of FIG. 3. When the user sets the original document image setting mode in operation S40, the scanned image D of the original document and the printing image P of the printing paper are displayed in the display area 33 of the LCD 32, as shown in FIG. 8A, to allow the user to set the image of the document in operation S41. At the same time, the pointer O of the original document is displayed in the display area 33 of the LCD 32 to indicate one of a leading edge, a corner, and a trailing edge of the printing paper. The pointer O of the original document serves as a guide to the user who has to set each position of the scanned and printing images D, P of the original document and the printing paper. Also, as shown in FIG. 7, arrows 35 are displayed on the scanned and printing images D, P of the original document and the printing paper to allow the user to adjust the position, the size and the rotational angle of the scanned and printing images D, P. If the user inputs the printing paper selecting mode, the desired size of the printing paper is selected in operation S42. If the user inputs the copy-start command in operation S7 after the document image setting and printing paper selecting operations S41 and S42 have been completed, the scanned image D is printed on the printing paper in operation S8.

Figure 5:
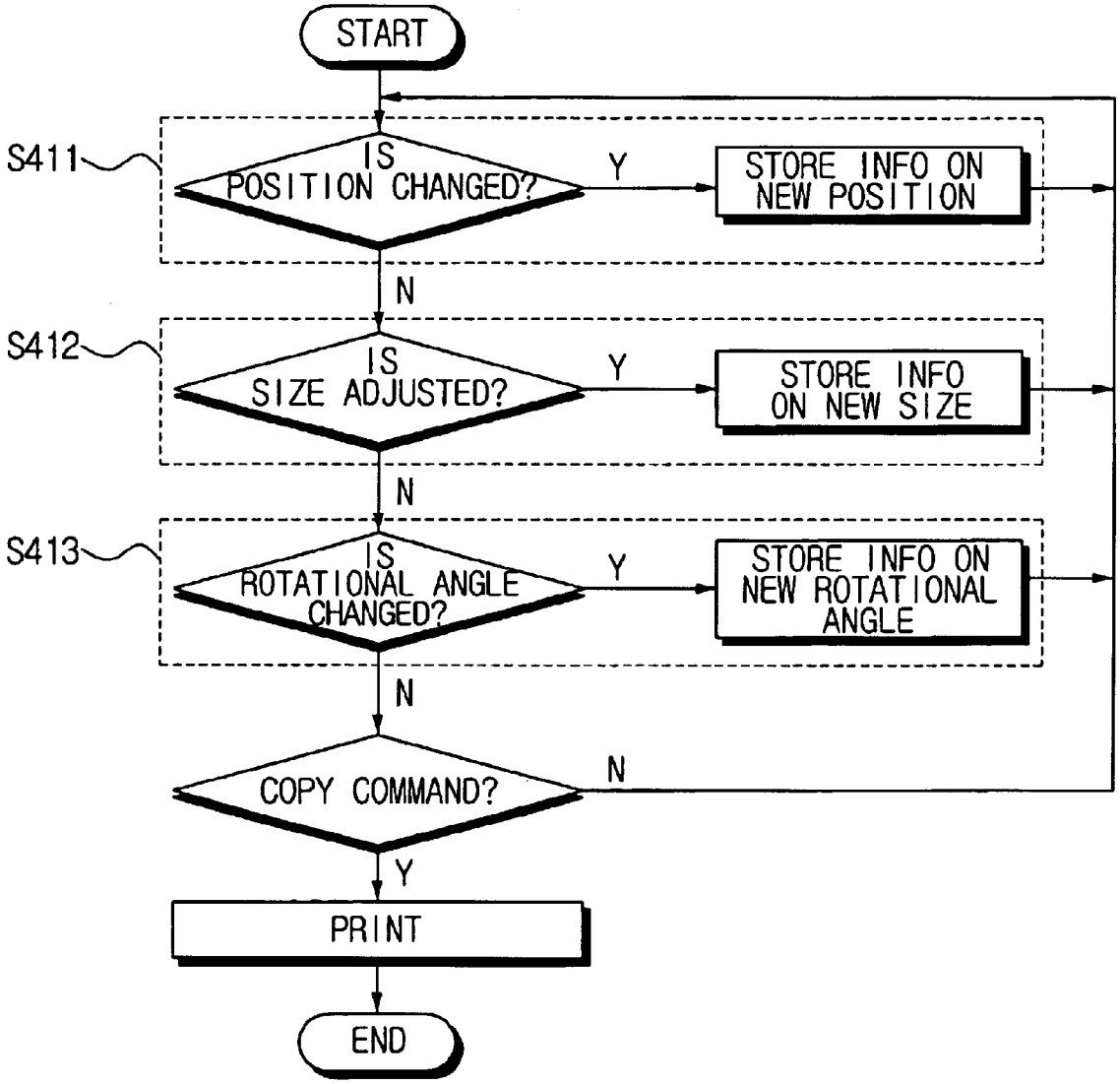
Figure 8B:
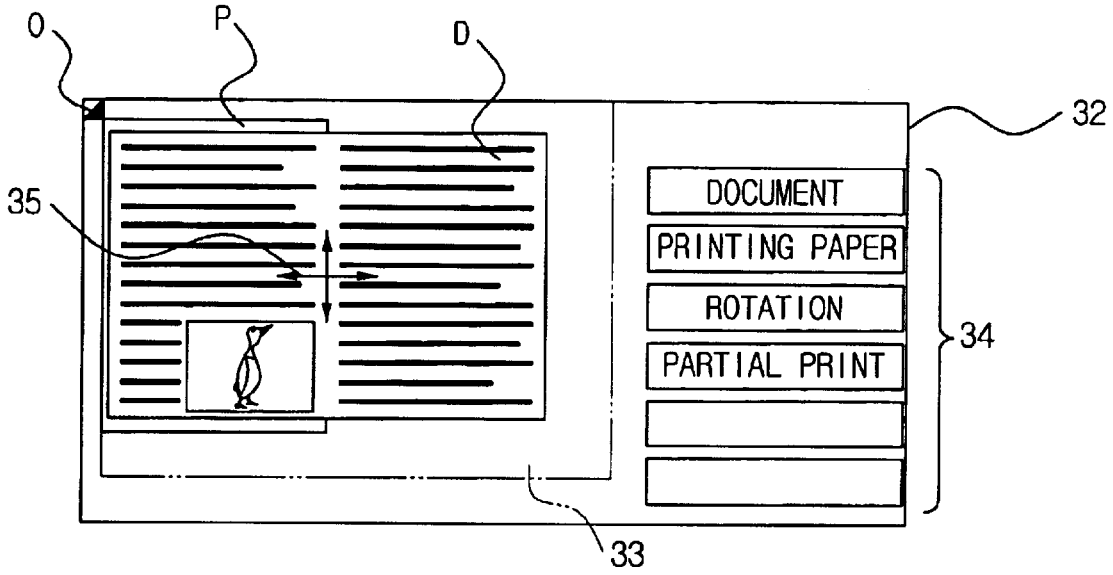

FIG. 5 shows a detailed flow chart of the document image setting and printing paper selecting operations S41 and S42 of FIG. 4. First, for setting the scanned image D of the original document, the user selects the original document setting mode by touching a portion of the touch panel 31 corresponding to an 'original document' icon displayed on the display portion 30 in operation S41. Accordingly, among the scanned image D of the original document and the printing image P of the printing paper displayed in the LCD 32, the scanned image D of the original document is displayed on the printing image P of the printing paper. The arrows 35 are displayed at a center and corners of the scanned image D, and the user drags, pushes, or touches the appropriate area of the touch panel 31 to adjust the scanned and printing images D, P. When setting the scanned image D of the original document, first, as shown in FIG. 8B, the user moves the scanned image D of the original document to a desired position by touching and dragging one of the arrows 35 displayed on the scanned image D of the original document in operation S411 of FIG. 5. At this time, the control portion 70 traces the touching and dragging of the one of the arrows 35, calculates a newly set position, i.e., a current position of the scanned image D based on the reference data, and displays the current position of the scanned image D in the LCD 32 in operation S6 of FIG. 3. Then the control portion 50 stores new information about the new current position in the memory portion 50 in operation S411.

Figure 8C:
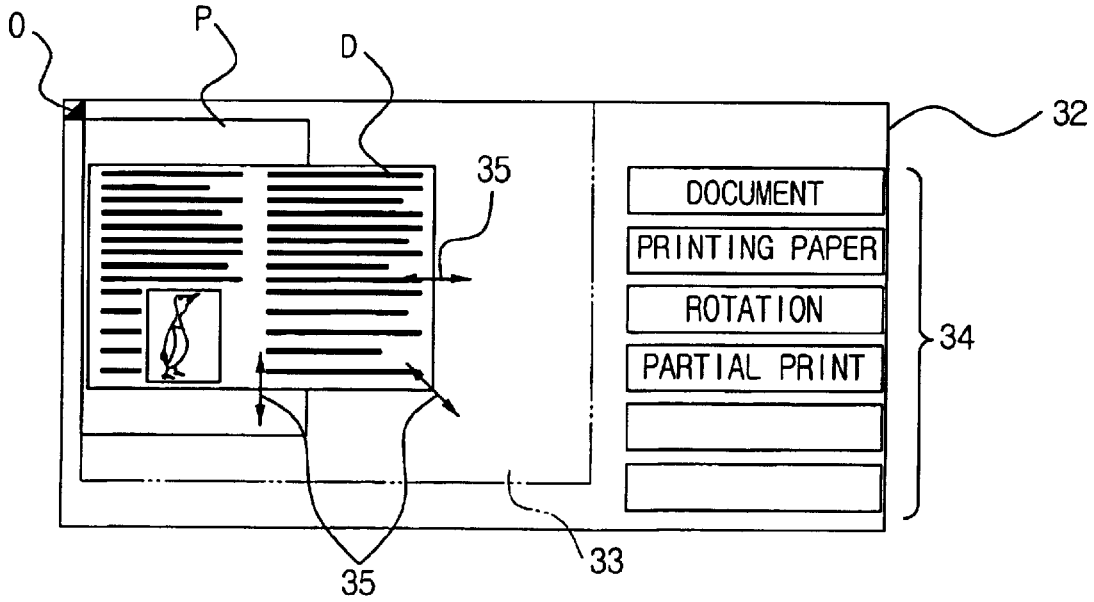

Next, the size of the scanned image D of the original document is set in operation S412 of FIG. 5 by the user touching and dragging the one of the arrows 35 disposed at edges and apexes of the scanned image D, as shown in FIG. 8C, to adjust the size of the scanned image D to a desirable size or a desired ratio with respect to the printing paper. As shown in FIG. 7, by touching and dragging one of the arrows 35 at a horizontal or vertical edge, the size of the scanned image D is extended in a corresponding direction. By dragging the one of the arrows 35 at one of the apexes of the scanned image D, two adjoining sides of the scanned image are extended accordingly. In this way, a frame of the scanned image D is adjusted to be smaller or larger. At this time, the control portion 70 traces the touching and dragging of each of the arrows 35, calculates the size of a newly set frame of the scanned image based on the reference data of the scanned image D stored in the storing portion 50, displays the calculated result in the LCD 32, and stores the new calculated information about the new scanned image D in the memory portion 50 in operation S412.

Figure 8D:
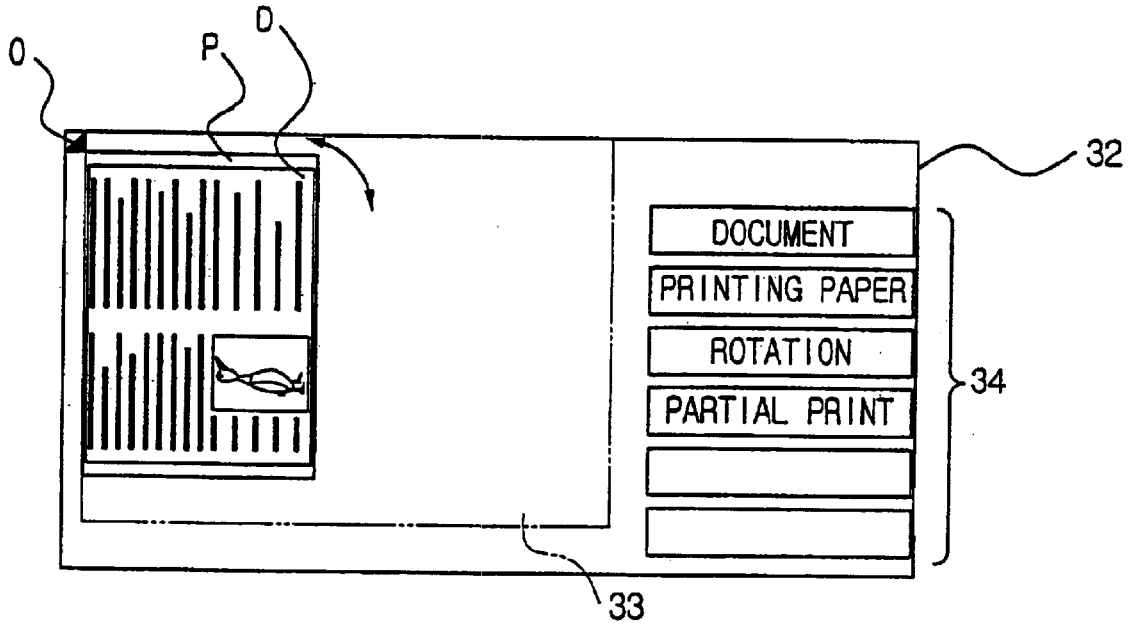

Further, the rotational angle of the scanned image D is adjusted in operation S413 of FIG. 5. First, the user selects a "rotation" icon from the icons displayed on the LCD 32 and touches and drags one of the apexes of the scanned image frame in a circular direction as shown in FIG. 8D. Accordingly, the scanned image D is rotated, and the output direction of the scanned image D is set. At this time, the control portion 70 traces the rotation of the scanned image D of the original document, calculates a new direction of the scanned image D with respect to the reference data of the scanned image D as stored in the memory portion in operation S413 of FIG. 5, displays in operation S6 the rotated scanned image D in the LCD 32, and stores new information about the rotated scanned image D in the memory portion 50 in operation S413.

After setting the position, the size and the rotational angles or a printing direction of the scanned image D of the original document in operations S411, S412, and S413 of FIG. 5, the user may select the printing paper by adjusting the printing image P of the printing paper in operation 42 of FIG. 4. Before the user sets the scanned image, the user may select the printing paper.

More specifically, if the user selects the "printing paper" icon, i.e., in the printing paper selecting mode selecting the type of the printing paper, the printing image P of the printing paper is displayed on the scanned image D of the original document on the LCD 32. As shown in FIG. 7, arrows 35 are indicated on the printing image P of the printing paper to enable the user to adjust the position, the size and the rotational angle or the printing direction of the scanned image. The position and the rotational angle of the printing images are set by the same method that is used above in order to set the position and the rotational angle of the scanned image D of the original document. The only difference is that, when the user touches and drags the arrows 35 on the printing image P of the printing paper and thus sets the printing image P to a predetermined size, the control portion 70 selects the printing paper, which is closest to the set printing image P) in size, contained in the cartridge 20, and displays the selected printing paper on the LCD 32 in operation S6 of FIG. 3.

Finally, when the user double-clicks on the scanned image D of the original document on the LCD 32 and thus inputs the operation-start command in operation S7, the control portion 70 prints the set scanned image D of the original document on the selected printing paper in operation S8 of FIG. 3.

Figure 8E:
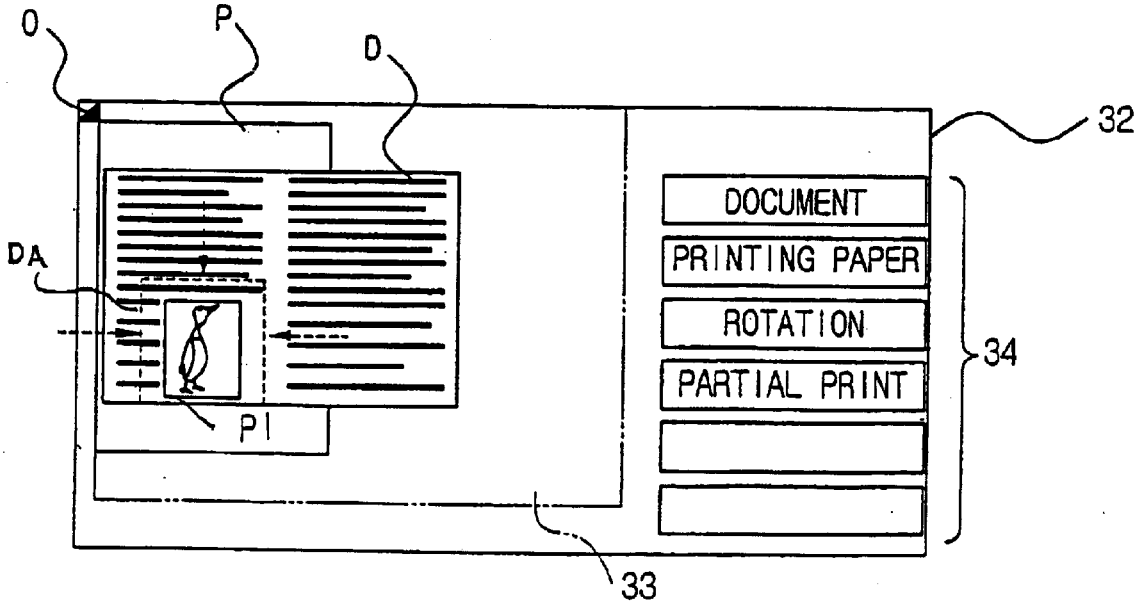

Meanwhile, as shown in FIG. 8E, when copying the partial image of the scanned image D of the original document, the user sets the partial output mode and sets a desired partial image DA from the scanned image D. The partial image DA of the scanned image D is set by the same method that sets the size of the scanned image D of the original document. More specifically, the partial image DA of the scanned image D is set by touching and dragging the arrows 35 indicated at the edges and apexes of the partial image DA of the scanned image D.

Figure 6:
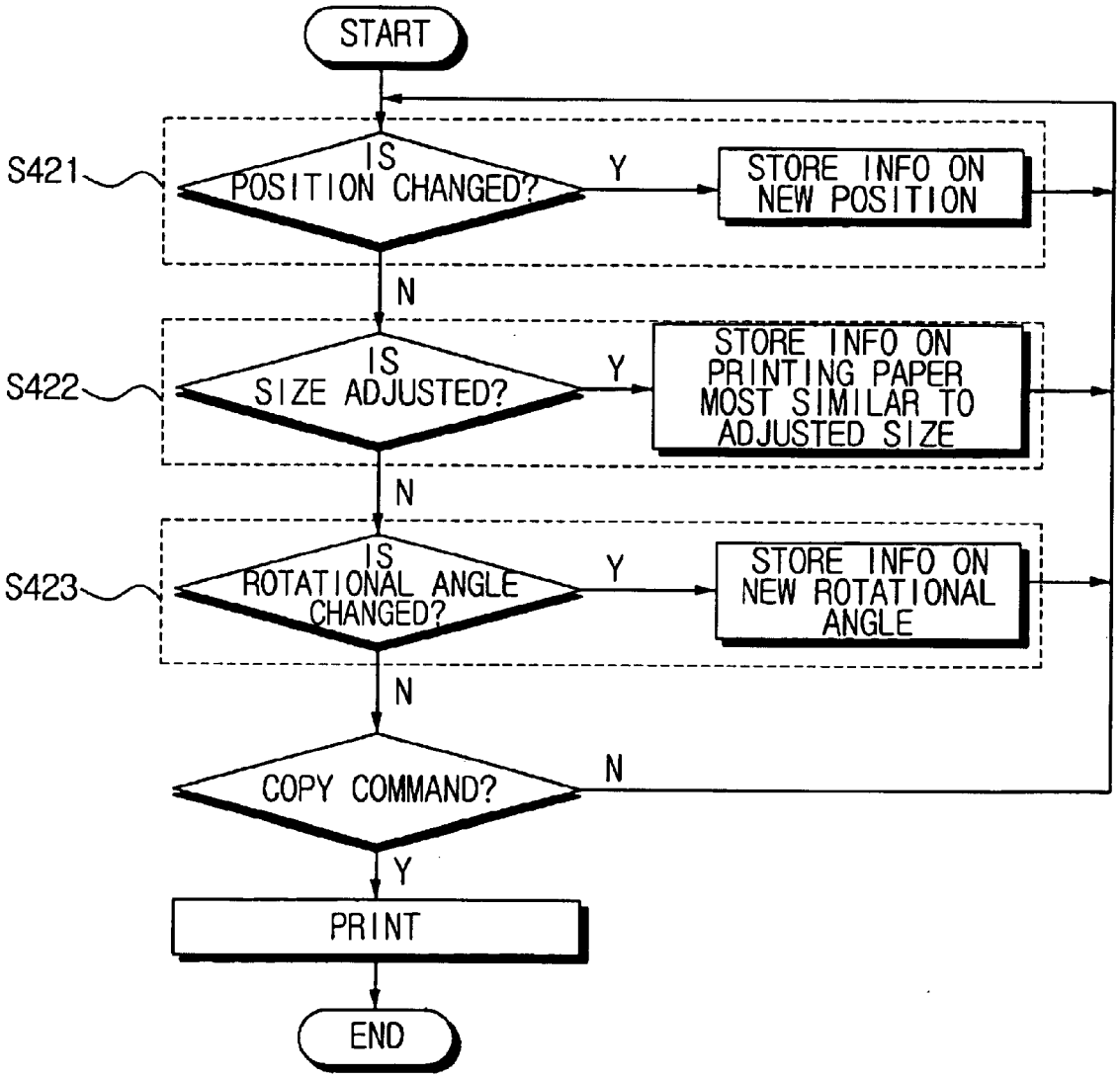

In FIG. 6, when the user selects a desired size of the scanned image or the printing paper, a certain size of printing paper, which is closest to the desired size of the scanned image or the printing paper, is automatically selected if the desired size of the printing paper is not available in the copier, and information about the certain size of the printing paper, which is the most similar size of the desired size, is stored in the storing portion 50 in operation S422. With the automatic selection of the certain size of the printing paper, the position and rotational angle of the scanned image may be set and stored in operations S421 and S423.

As described above, the user checks the size of the scanned image D of the original document and the printing image P of the printing paper through the display prior to the copy operation, and accordingly, a waste of paper and time during the copy operation can be avoided. Also, since the user sets and selects the scanned image D and the printing image P of the printing paper by adjusting the position, the size and the rotational angle or the printing direction through the touch panel 31 by the user touching and dragging, the user uses the copier with greater convenience.

According to the present invention, first, the scanned image D of the original document and the printing image P of the printing paper are displayed in the display so that the user knows the position and the size of the original document and the printing paper. Accordingly, the waste of time and paper can be avoided. Second, since the user is enabled to set the position, the size and the rotational angle of the scanned image D of the original document and the printing image P of the printing paper prior to the copy operation, the user can use the copier with greater convenience.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A copier, comprising:

a scanning portion scanning a document and generating a scanned image of the document;

a cartridge containing at least one type of printing paper;

an output portion printing the scanned image of the document onto the printing paper; and a liquid crystal display portion displaying the scanned image and a printing image representing a state that the scanned image of the document is printed on the printing paper.

2. The copier of claim 1, further comprising an input portion inputting a selection command selecting the type of the printing paper where the scanned image of the document is to be printed, wherein the display portion displays the printing image representing the state that the scanned image of the document is printed on the type of the printing paper in response to the selection command.

3. The copier of claim 1, wherein, among different types of the printing paper contained in the cartridge, the display portion selects the type of the printing paper that has a size closest to the scanned image of the document.

4. A copier, comprising:

a scanning portion scanning a document and generating a scanned image of the document;

a cartridge containing at least one type of printing paper;

an output portion printing the scanned image of the document onto the printing paper;

a display portion displaying the scanned image and a printing image representing a state that the scanned image of the document is printed on the printing paper; and an input portion enabling a user to input a setting command setting at least one of a position, a size and an angle of the scanned image of the document to be printed on the printing paper, wherein the display portion displays the scanned image of the document in response to the setting command.

5. The copier of claim 4, wherein the input portion is provided on the display portion and includes a touch panel through which the user inputs the setting command by touching the touch panel.

6. A copier, comprising:

a scanning portion scanning a document and generating a scanned image of the document;

a cartridge containing at least one type of printing paper;

an output portion printing the scanned image of the document onto the printing paper;

a display portion displaying the scanned image and a printing image representing a state that the scanned image of the document is printed on the printing paper; and an input portion inputting a partial output command printing a part of the scanned image, wherein the display portion displays the part of the scanned image in response to the partial output command.

7. A copier, comprising:

a scanning portion scanning a document and generating a scanned image of the document;

a cartridge containing at least one type of printing paper;

an output portion printing the scanned image of the document onto the printing paper;

a display portion displaying the scanned image and a printing image representing a state that the scanned image of the document is printed on the printing paper;

a cover covering the document disposed on the scanning portion; and a sensor detecting opening and closing of the cover, wherein the display portion displays the scanned image when the sensor detects the closing of the cover.

8. A method of controlling a copying operation of a copier, comprising:

scanning an image of a document;

displaying the scanned image of the document and a printing image representing a state that the scanned image of the document is printed on printing paper;

inputting a setting command setting at least one of a position, a size and angle of the scanned image of the document to be printed on the printing paper;

re-displaying the scanned image and the printing image in response to the setting command; and outputting the re-displayed scanned image onto the printing paper according to an output start command.

9. The control method of claim 8, further comprising providing a touch panel, wherein the setting command is inputted through the touch panel.

10. The control method of claim 8, further comprising selecting one type of the printing paper among a plurality of types of the printing paper contained in a cartridge, the printing paper having a size closest to the scanned image of the document, wherein the scanned image of the document is printed on the printing paper.

11. The control method of claim 8, further comprising inputting a partial output command printing a partial image of the scanned image of the document, wherein the partial image of the scanned image is re-displayed in response to the partial output command.

12. A copier, comprising:

a scanning portion scanning a document and generating a scanned image of the document;

a control portion generating a printing image representing that the scanned image of the document is printed on printing paper;

a liquid crystal display portion displaying both the scanned image and the printing image; and an output portion printing the scanned image in accordance with the printing image.

13. The copier of claim 12, further comprising a cartridge containing the printing paper and generating a paper type signal corresponding to the printing paper, wherein the control portion selects the printing paper in response to the paper type signal.

14. The copier of claim 13, wherein the printing image is generated in accordance with the printing paper selected by the control portion.

15. The copier of claim 12, further comprising a cartridge containing different types of printing paper and generating paper type signals corresponding to respective types of the printing paper, wherein the control portion selects one of the different types of the printing paper as the printing paper in response to the paper type signals.

16. The copier of claim 15, wherein the selected one of the different types of the printing paper is closest to the scanned image of the document in size.

17. The copier of claim 16, wherein the printing image is generated in accordance with the selected one of the different types of the printing paper.

18. The copier of claim 15, further comprising an input portion inputting a selecting command controlling the control portion to select the one of the different types of the printing paper, wherein a controller generates the printing image in accordance with the setting command.

19. The copier of claim 12, further comprising a memory portion storing information about the printing paper, the scanned image of the document, and the printing image.

20. A copier, comprising:

a scanning portion scanning a document and generating a scanned image of the document;

a control portion generating a printing image representing that the scanned image of the document is printed on printing paper;

a display portion displaying both the scanned image and the printing image;

an output portion printing the scanned image in accordance with the printing image; and an input portion inputting a partial image printing command selecting a partial image included in the scanned image of the document, wherein the control portion generates the printing image representing the state that the partial image is printed on the printing paper in accordance with the partial image printing command.

21. A copier, comprising:

a scanning portion scanning a document and generating a scanned image of the document;

a control portion generating a printing image representing that the scanned image of the document is printed on printing paper;

a display portion displaying both the scanned image and the printing image;

an output portion printing the scanned image in accordance with the printing image; and an input portion inputting a setting command setting one of a position, a size and a rotation angle of the scanned image of the document, wherein the control portion generates the printing image in accordance with the setting command.

22. The copier of claim 21, wherein the printing image and the scanned image are automatically generated and displayed on the display portion when the document is scanned.

23. A copier, comprising:

a scanning portion scanning a document and generating a scanned image of the document;

a control portion generating a printing image representing that the scanned image of the document is printed on printing paper;

a display portion displaying both the scanned image and the printing image;

an output portion printing the scanned image in accordance with the printing image;

a cover opening and closing the scanning portion;

a sensor detecting the opening and the closing of the cover and generating a detecting signal; and the control portion generating the scanned image and the printing image in response to the detecting signal.

24. The copier of claim 23, wherein the display portion displays the scanned image and the printing image in response to the detecting signal.

25. A copier, comprising:

a scanning portion scanning a document and generating a scanned image of the document;

a control portion generating a printing image representing that the scanned image of the document is printed on printing paper;

a display portion displaying both the scanned image and the printing image;

an output portion printing the scanned image in accordance with the printing image, wherein the display portion comprises:

a liquid crystal display device displaying the scanned image and the printing image, and a touch panel disposed on the liquid crystal display device enabling a user to input a command signal adjusting the scanned image and the predetermined printing paper.

26. The copier of claim 25, wherein the command signal includes one of a setting command selling one of a position, a size and a rotational angle of the scanned image with respect to the predetermined printing paper, a selecting command selecting the predetermined printing paper from various types of the printing paper, a partial output command generating a second scanned image corresponding to a partial image contained in the scanned image and a second printing image corresponding to the second scanned image.

27. The copier of claim 25, wherein the liquid crystal display device displays icons to enable the user to input the command signal by touching a portion of the touch panel corresponding to one of the icons.

28. The copier of claim 25, wherein the liquid crystal display device displays arrows on one of the scanned image and the printing image, the arrows enabling the user to adjust one of a position, a size and a rotation angle of the scanned image of the document with respect to the printing paper by touching or dragging a portion of the touch panel corresponding to one of the arrows displayed on the liquid crystal display device.

29. The copier of claim 28, wherein the arrows are displayed at a center and a corner of the scanned image.

30. The copier of claim 28, wherein the control portion detects the one of the arrows touched by the user, calculates one of a newly set position, a newly set size, and a newly set rotation angle in response to the touched one of the arrows with respect to the scanned image, and generates a second scanned image based on the corresponding calculated position, size, and rotation angle.

31. The copier of claim 30, wherein the display portion displays the second scanned image and a second printing image in accordance with the second scanned image.

32. The copier of claim 31, further comprising a memory portion storing information about the printing paper, the second scanned image, and the second printing image.

33. A copier, comprising:

a scanning portion scanning a document and generating a scanned image of the document;

a control portion generating a printing image representing that the scanned image of the document is printed on printing paper;

a display portion displaying both the scanned image and the printing image; and an output portion printing the scanned image in accordance with the printing image, wherein the document comprises a two page image, wherein the scanned image and the printing image include the two page image, a first page image of the two page image adjusted with respect to the printing paper while a second page image of the two page image is not adjusted.

34. A method of controlling a copying operation in a copier, comprising:

scanning an image of a document and generating a scanned image;

generating a printing image representing a state that the scanned image is printed on printing paper; and displaying both the scanned image and the printing image on a liquid crystal display.

35. The method of claim 34, wherein the copier comprises a cartridge containing different types of printing paper, the method further comprising:

generating paper type signals corresponding to respective ones of the different types of printing paper; and selecting one of the different types of the printing paper in response to the paper type signals.

36. The method of claim 35, wherein the selected one of the different types of the printing paper is closest to the scanned image of the document in size.

37. The method of claim 34, wherein the copier comprises a cartridge containing different types of printing paper, the method further comprising:

inputting a setting command selecting one of the different types of the printing paper; and selecting the one of the different types of the printing paper in response to the setting command.

38. A method of controlling a copying operation in a copier, comprising:

scanning an image of a document and generating a scanned image;

generating a printing image representing a state that the scanned image is printed on printing paper;

displaying both the scanned image and the printing image;

inputting a setting command setting one of a position, a size, and an angle of the scanned image of the document with respect to the printing paper;

generating a second scanned image adjusted from the scanned image in response to the setting command and a second printing image adjusted in response to the second scanned image; and displaying the second scanned image and the second printing image.

39. The method of claim 38, further comprising:

inputting an output start command; and printing the second scanned image in response to the output start command.

40. The method of claim 38, further comprising:

enabling a user to input the setting command through a touch panel.

41. A method of controlling a copying operation in a copier, comprising:

scanning an image of a document and generating a scanned image;

generating a printing image representing a state that the scanned image is printed on printing paper;

displaying both the scanned image and the printing image;

inputting a partial output command;

generating a partial image contained in the scanned image as a second scanned image in response to the partial output command;

generating a second printing image in accordance with the second scanned image; and printing the second scanned image in accordance with the second printing image.

* * * * *

UNITED STATES PATENT AND TRADEMARK OFFICE

CERTIFICATE OF CORRECTION

PATENT NO. : 6,748,185 B2
DATED : June 8, 2004
INVENTOR(S) : Gwan-seob Song

It is certified that error appears in the above-identified patent and that said Letters Patent is hereby corrected as shown below:

Column 11,
Line 10, delete “the” (second occurrence);
Line 13, change “selling” to -- setting --.

Signed and Sealed this

Twenty-first Day of December, 2004

JON W. DUDAS
*Director of the United States Patent and Trademark Office*